US008256257B2

(12) United States Patent
Shore et al.

(10) Patent No.: US 8,256,257 B2
(45) Date of Patent: Sep. 4, 2012

(54) METHOD OF OPERATING AN APPARATUS FOR DECELERATING AND TEMPORARILY ACCUMULATING HOT ROLLED LONG PRODUCTS

(75) Inventors: T. Michael Shore, Princeton, MA (US); Kenneth Plante, Holden, MA (US); Yun Ling, Shrewsbury, MA (US)

(73) Assignee: Siemens Industry, Inc., Alpharetta, GA (US)

( * ) Notice: Subject to any disclaimer, the term of this patent is extended or adjusted under 35 U.S.C. 154(b) by 27 days.

(21) Appl. No.: 12/971,238

(22) Filed: Dec. 17, 2010

(65) Prior Publication Data

US 2012/0151983 A1 Jun. 21, 2012

(51) Int. Cl.
*B21B 41/10* (2006.01)

(52) U.S. Cl. ..... 72/230; 72/231; 72/250

(58) Field of Classification Search ..... 72/250, 72/251, 226–231, 135–145, 66
See application file for complete search history.

(56) References Cited

U.S. PATENT DOCUMENTS

| | | | |
|---|---|---|---|
| 35,184 | A | 11/1886 | Lenox |
| 1,935,048 | A | 11/1933 | Gassen |
| 3,486,359 | A | 12/1969 | Hein |
| 3,729,972 | A | 5/1973 | Kocks |
| 3,774,433 | A | 11/1973 | Pauels |
| 3,942,350 | A | 3/1976 | Brauer |
| 4,028,920 | A | 6/1977 | Zander |
| 4,457,154 | A | 7/1984 | Ohba |
| 5,307,663 | A | 5/1994 | Lawendowski |
| 5,312,065 | A | 5/1994 | Shore |
| 5,595,354 | A | 1/1997 | Josoff |
| 5,893,288 | A | 4/1999 | Shore |
| 7,021,103 | B2 | 4/2006 | Shore |
| 7,093,472 | B1 | 8/2006 | Gauthier |
| 2002/0177972 | A1 | 11/2002 | Renzine |

OTHER PUBLICATIONS

Double Pendulum, www.myphysicslab.com/dbl_pendulum.html, Accessed Feb. 28, 2012.*

PCT International Search Report mailed Mar. 9, 2012 corresponding to PCT International Application No. PCT/US2011/062496 filed Nov. 30, 2011 (10 pages).

* cited by examiner

*Primary Examiner* — Edward Tolan
*Assistant Examiner* — Matthew G Katcoff

(57) ABSTRACT

A method for operating an apparatus for decelerating and temporarily accumulating a hot rolled long product. The product is deposited on a rotating drum in the form of a helix, and is simultaneously unwound from the drum to a receiving guide movable incrementally along a path parallel to the rotational axis of the drum. Immediately upon entry of the product front end into the receiving guide, the incremental movement of the receiving guide is preceded by an initial rapid shifting through a distance adequate to prevent subsequent product convolutions of the helix from buckling and overlapping.

2 Claims, 2 Drawing Sheets

METHOD OF OPERATING AN APPARATUS FOR DECELERATING AND TEMPORARILY ACCUMULATING HOT ROLLED LONG PRODUCTS

FIELD OF THE INVENTION

Embodiments of the present invention relate generally to continuous rolling mills producing hot rolled long products such as bars, rods and the like, and are concerned, more particularly, with an improvement in the operation of an apparatus for decelerating and temporarily accumulating such products at an intermediate stage in the hot rolling process.

BACKGROUND

A known apparatus for decelerating and accumulating hot rolled long products is disclosed in U.S. Pat. No. 7,021,103, the description of which is therein incorporated by reference, With this type of apparatus, as depicted schematically herein in FIGS. 1 to 3A, a hot rolled product 10 is directed at a velocity $V_1$ through a curved delivery guide 12. The guide has an entry end 12*a* aligned with an axis "A" to receive the product, and a delivery end 12*b* spaced radially from axis A. The delivery end is orientated to deliver the product in an exit direction and at an angle θ with respect to a reference plane "P" perpendicular to axis A.

The guide 12 is rotated continuously about axis A in a direction opposite to the exit direction of the product and at a rotational speed at which the exit end 12*b* of the guide has a velocity $V_2$, thereby decelerating the product being delivered from the guide's exit end to a reduced velocity $V_3$ equal to $V_1$-$V_2$. The curvature of the guide and the exit angle θ are such as to form the delivered product into a helix which is received and temporarily accumulated on a cylindrical drum 14 aligned on axis A.

The drum 14 is rotated about axis A in a direction opposite to the direction of rotation of the curved guide 12 to thereby unwind the temporarily accumulating product.

A receiving guide 16 is movable to and fro along a path "B" parallel to axis A. At the beginning of a coiling operation, and as shown in FIGS. 3 and 3A, the exit end 12*b* of the guide 12 is rotationally located at an angle α with respect to the receiving guide 16, and the receiving guide is located at an initial position adjacent to but outside of the rotational path of the guide exit end 12*b*.

In accordance with conventional practice, once the front end of the product entered the receiving guide 16, it was heretofore thought adequate to begin incrementally advancing the receiving guide along path B and away from plane P through incremental distances slightly greater than the diameter of the product. However, it has now been determined that such incremental advancement is insufficient to prevent successive convolutions of the product from buckling and overlapping, each other. When this occurs, the ordered unwinding of the product is adversely affected, and in extreme cases, completely interrupted.

SUMMARY

In accordance with embodiments of the present invention, immediately upon entry of the product front end into the receiving guide 16, the incremental advancement of the receiving guide along path B is preceded by an initial rapid shifting of the receiving guide through a distance adequate to prevent subsequent product convolutions from buckling and overlapping.

DETAILED DESCRIPTION

Figure 1:
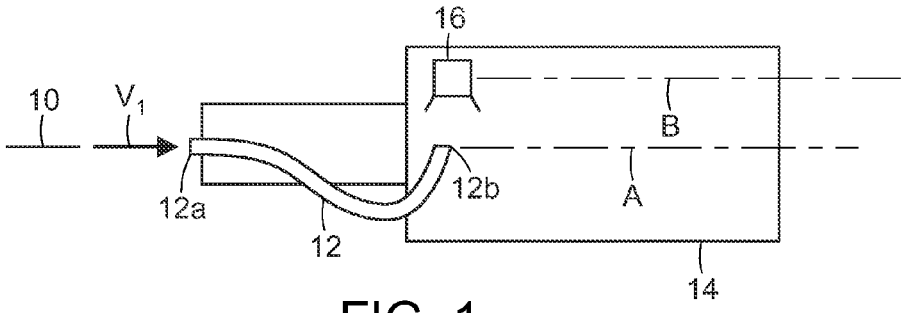
FIG. 1 (Prior Art)
FIG. 1 is a diagrammatic illustration of a known apparatus for decelerating and temporarily accumulating hot rolled long products.
Figure 2:
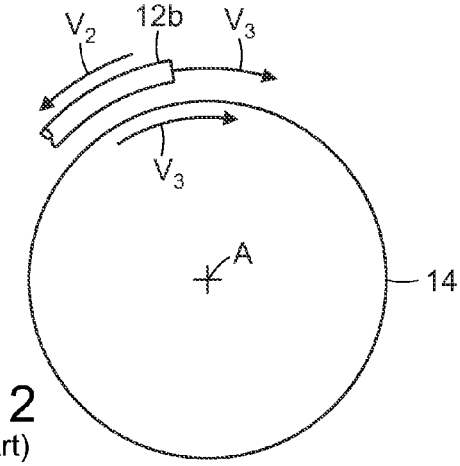
FIG. 2 (Prior Art)
FIG. 2 is a diagrammatic illustration showing the relative rotation and speeds of components of the apparatus depicted in FIG. 1.
Figure 3:
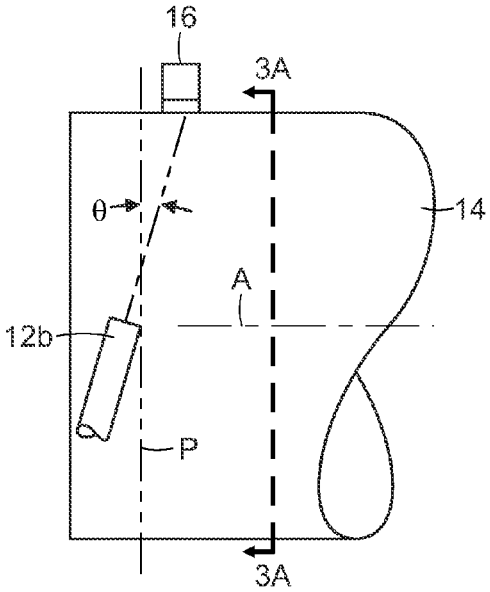
FIG. 3 (Prior Art)
FIGS. 3 and 4 are enlarged views of a section of the apparatus disclosed in FIG. 1.
Figure 3A:
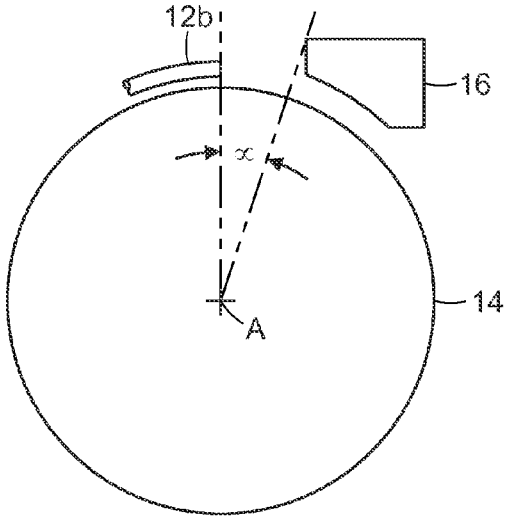
FIG. 3A (Prior Art)
FIG. 3A and 4A are sectional views taken respectively on lines 3A-3A and 4A-4A of FIGS. 3 and 4.
Figure 4A:
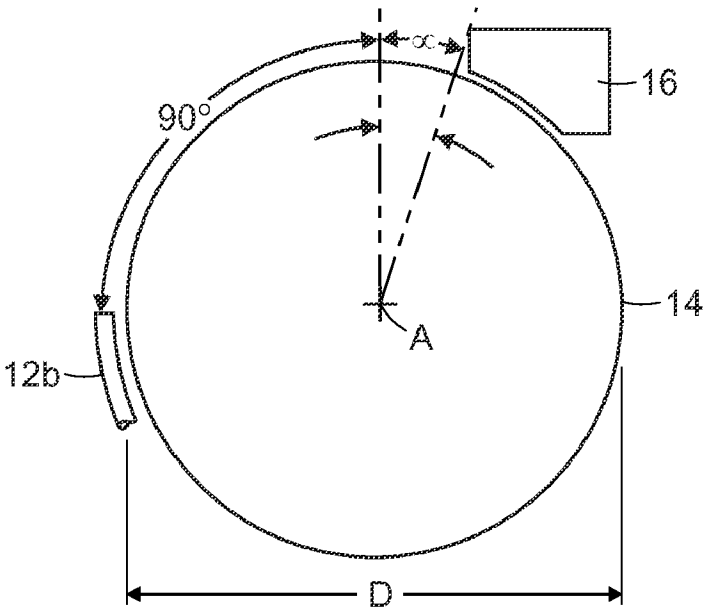
Figure 4:
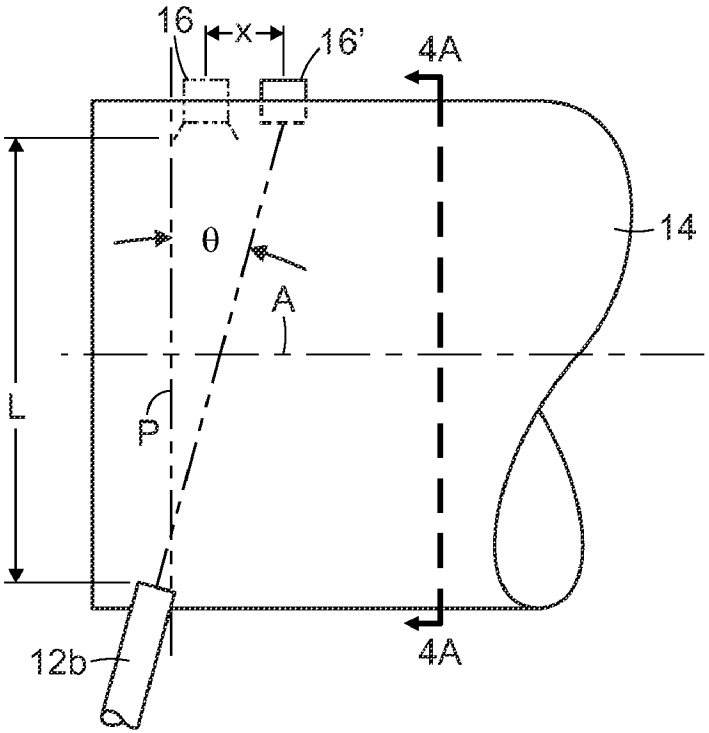

In accordance with embodiments of the present invention, and as depicted in FIGS. 4 and 4A, immediately upon entry of the product front end into the receiving guide 16, the receiving guide is shifted along path B away from plane P through a distance X=L sin θ to a second position 16', where $$L = \pi \cdot D \cdot \left(\frac{\alpha + 90}{360}\right)$$

and D is the outside diameter of the drum 14.

Typically, α will range between 15-30°, depending on the value of θ.

Shifting of the receiving guide 16 through distance X should preferably be accomplished in the time that elapses during 1 to 3 revolutions of the guide 12 about axis A.

Once the receiving guide arrives at its second position 16', it is then shifted incrementally in accordance with conventional practice.

What is claimed is:

1. A method of decelerating and temporarily accumulating a hot rolled product moving longitudinally along a receiving axis at a first velocity $V_1$, said method comprising:

directing said product through a curved delivery guide having an entry end aligned with said axis to receive said product, and an exit end spaced radially from said axis and orientated to deliver said product in an exit direction and at an exit angle ∞ with respect to a reference plane perpendicular to said axis;

continuously rotating said delivery guide about axis in a direction opposite to said exit direction and at a rotational speed at which said exit end has a velocity $V_2$, thereby decelerating the product being delivered from said exit end to a reduced velocity $V_3$ equal to $V_1$-$V_2$, the curvature of said delivery guide and said exit angle being such as to form the product delivered from said exit end into a helix;

receiving and temporarily accumulating said helix on a cylindrical drum aligned on said axis;

rotating said drum about said axis in a direction opposite to the direction of rotation of said delivery guide to thereby unwind the product accumulating temporarily on said drum;

arranging a receiving guide at an initial position to receive a front end of the product unwinding from said drum;

upon receipt of said product front end by said receiving guide, rapidly moving said receiving guide from said initial position and along a linear path parallel to said axis through an initial distance X=L·sin θ where:

$$L = \pi \cdot D \cdot \left( \frac{\alpha + 90}{360} \right)$$

D=diameter of said drum

α=angle of rotation of said exit end from said receiving guide at said initial position the movement of said receiving guide through said initial distance being accomplished in the time that elapses between 1 and 3 revolutions of said delivery guide.

2. The method of claim 1, wherein α ranges between 15-30°.

* * * * *